United States Patent [19]

Von Schwerdtner et al.

[11] Patent Number: 4,530,212

[45] Date of Patent: Jul. 23, 1985

[54] TURBINE CONDENSER WITH AT LEAST ONE BYPASS STEAM INLET LEADING INTO THE STEAM DOME

[75] Inventors: Otto Von Schwerdtner; Hans Gossen, both of Mulheim; Jürgen Günther, Wesel; Hans Peters, Mulheim, all of Fed. Rep. of Germany

[73] Assignee: Kraftwerk Union Aktiengesellschaft, Mulheim, Fed. Rep. of Germany

[21] Appl. No.: 547,245

[22] Filed: Oct. 31, 1983

[30] Foreign Application Priority Data

Nov. 2, 1982 [DE] Fed. Rep. of Germany ..... 3240453

[51] Int. Cl.[3] ..... F01K 19/00

[52] U.S. Cl. ..... 60/657; 60/653

[58] Field of Search ..... 60/646, 652, 653, 656, 60/657, 685

[56] References Cited

U.S. PATENT DOCUMENTS 3,919,846 11/1975 Lecocq ..... 60/657

FOREIGN PATENT DOCUMENTS 1014568 8/1957 Fed. Rep. of Germany .

132408 10/1981 Japan ..... 646/

*Primary Examiner*—Stephen F. Husar

*Attorney, Agent, or Firm*—Herbert L. Lerner; Laurence A. Greenberg

[57] ABSTRACT

A turbine condenser includes a steam dome of the condenser having a wall. At least one bypass steam inlet discharges into the steam dome. The bypass steam inlet includes a bypass valve for controlling the amount of bypass steam in the bypass steam inlet and at least two series-connected throttling devices disposed downstream of the bypass valve for decompressing the bypass steam. Each respective throttling device disposed relatively further downstream has a larger cross section than each throttling device disposed relatively further upstream. The throttling device disposed farthest downstream is in the form of an insert disposed in the steam dome conforming to the curvature of the steam dome wall. A device is provided for injecting water into the bypass steam inlet cooling the bypass steam.

12 Claims, 4 Drawing Figures

TURBINE CONDENSER WITH AT LEAST ONE BYPASS STEAM INLET LEADING INTO THE STEAM DOME

The invention relates to a turbine condenser with at least one bypass steam inlet leading into the steam dome, including a bypass valve for controlling the amount of bypass steam, a throttling uevice for decompressing the bypass steam and a water injection device for cooling the bypass steam.

In steam power generating stations, the excess steam production of the boiler is conducted directly into the steam dome of the turbine condenser through one, two or more bypass steam inlets. Such operating conditions occur temporarily when the turboset is started up or shut down, during fast load drops and in the case of load shedding. The bypass steam inlets are therefore equipped with a bypass valve for controlling the amount of bypass steam, a throttling device for expanding the bypass steam, and a water injection device for cooling the bypass steam. The thermal gradient which must be throttled down in such a bypass steam inlet, is very large. The steam pressure upstream of the bypass valve therefore customarily reaches 45 bar, while the counterpressure in the turbine condenser is at about 0.1 bar. When the steam expands in the throttling device of a bypass steam inlet, high supersonic velocities are therefore generated. This has a detrimental effect since extremely loud and very objectionable noises are produced. In addition, there is the danger that affected parts such as turbine blades, condenser tubes and steam dome walls will be excited to vibration and that water droplets impinging at high velocity will lead to an erosion of the component surfaces. It must also be taken into consideration that tne steam mass flow to be conducted into the steam dome of the turbine condenser is very large. Even if several bypass steam inlets are connected in parallel, extremely large volume flows are still produced so that sufficiently large throttling cross sections can no longer be made available for structural reasons, and limits are therefore set for the decompression.

German Published, Prosecuted Application DE-AS No. 10 14 568, discloses a turbine condenser having a steam dome into which the bypass steam is introduced through one or two pipes extending in the longitudinal direction of the condenser. The bypass steam is conducted into the tube path of the turbine condenser in such a way that direct exposure of endangered components is avoided, by perforating the pipe wall which extends over the entire length in a precise manner. The bypass steam is first cooled by a water injection pipe disposed inside the pipe. In such a bypass steam inlet, it would be possible to obtain a reduction of the noise as well as a reduction of the danger of vibrations being excited in the components, through appropriate construction of the cross section and the perforations. On the other hand, the perforated pipe of the bypass steam inlet must be disposed in the region in which the exhaust steam of the turbine is introduced into the turbine condenser. In order to avoid disturbances of the exhaust steam stream conducted from the turbine into the turbine condenser, sufficiently large throttling cross sections cannot be made available for the desired decompression of the bypass steam because of space limitations, even by perforating tne tube.

A company publication of the firm Kraftwerk Union AG, Mülheim on the Ruhr, Germany (Order No. KWU 7118), discloses a turbine condenser in which two or more bypass steam inlets are welded into the wall of the steam dome on the end surface of the condenser. The bypass steam inlets each contain a bypass valve and a steam cooling aperture which is disposed downstream thereof, in which the bypass steam is decompressed and cooled by injected water or condensate. Downstream of the steam cooling aperture, the remaining decompression of the bypass steam is accomplished by a short section of pipe or by feeding directly into the steam dome. Bypass steam inlets constructed in this manner have the advantage of being able to avoid interfering internal components in the steam dome of the turbine condenser with a very simple structure. On the other hand, however, the proportion of post expansion into the steam dome is relatively high, since the cross section of the steam cooling aperture provided as the throttling device is limited for structural reasons. Further more, the bypass steam enters the steam dome in the form of a focused individual jet.

It is accordingly an object of the invention to provide a turbine condenser with at least one bypass steam inlet leading into the steam dome of the turbine condenser, which overcomes the hereinafore-mentioned disadvantages of the heretofore-known devices of this general type, and to do so in such a manner that the development of noise is greatly reduced without appreciably interfering with the exhaust steam stream of the turbine, and that the danger of vibrations being excited and the droplet impact erosion of turbine blades, condenser tubes, housing walls and other exposed components, is eliminated.

With the foregoing and other objects in view there is provided, in accordance with the invention, a turbine condenser, comprising a steam dome having a wall, at least one bypass steam inlet discharging into the steam dome, the bypass steam inlet including a bypass valve for controlling the amount of bypass steam in the bypass steam inlet, at least two series-connected throttling devices disposed downstream of the bypass valve in flow direction of the bypass steam for decompressing the bypass steam, each respective throttling device disposed relatively further downstream having a larger cross section than each throttling device disposed relatively further upstream, the final or last, throttling device disposed farthest downstream being in the form of an insert with a convex curvature and a multiplicity of holes formed therein disposed in the steam dome conforming to the contour of said steam dome wall, and a device for injecting water into the bypass steam inlet cooling the bypass steam.

The invention is based on the insight, that with throttling devices having throttling cross sections increasing as viewed downstream, velocities of the bypass steam which are substantially higher than the velocity of sound, can be avoided. This is true for the entire decompression region, i.e. even for the region downstream of the last throttling device, provided a sufficiently large throttling cross section of the last throttling device can be made available. For this reason, the last or farthest downstream throttling device is formed of an insert which conforms to the steam dome wall on the inside, and a multiplicity of holes is made in the wall of the steam dome which has a convex curvature. By placing the insert inside the steam dome, a sufficiently large area is provided for the holes of the inserts, so that the residual gradient is accordingly small. Since the insert conforms to the steam dome wall on the inside, no appreciable degradation of the exhaust steam stream of the turbine is encountered, in spite of the large throttling cross section. The wall of the insert, which has a convex curvature and is provided with a multiplicity of holes, also provides a divergent flow of the individual steam jets generated in the holes, due to its curvature. The steam jets entering the steam dome therefore do not interfere with each other and cannot be reunified to form a single jet. The bypass steam is accordingly introduced into the steam dome in the form of a multiplicity of individual free jets. The short jet length thereof avoids the danger of exposing components with droplet-impact erosion, as well as the danger of the excitation of vibrations.

In order to further reduce a degradation of the exhaust steam flow of the turbine even further, in accordance with another feature of the invention, the insert is in the form of an at least substantially vertically aligned multi-hole cylindrical section being cut or sectioned parallel to the axis thereof and having boundary walls. This multi-hole partial cylinder is therefore fastened to the wall of the steam dome in the flow direction of the exhaust steam.

In accordance with a further feature of the invention, the insert is in the form of a multi-hole semicylinder. In this way, the strength properties are improved and the fabrication is also facilitated. In accordance with an added feature of the invention, the boundary walls are solid, i.e. have no holes. Therefore, all the steam jets issuing from the last throttling device extend at least approximately in the horizontal direction.

In accordance with an additional feature of the invention, the boundary walls include an upper wall being upwardly inclined toward the steam dome wall. Such a shape is considered to be particularly advantageous as far as the aerodynamic flow is concerned.

In accordance with again another feature of the invention, the throttling devices include a first throttling device in the form of a multi-hole throttling cone, and a second throttling device in the form of a steam cooling aperture. These are disposed downstream of the bypass valve, one behind the other. Besides its throttling function, the multi-hole throttling cone in this case serves the purpose of settling the steam flow, which is highly turbulent downstream of the bypass valve. In addition, the pressure of the water injection device disposed downstream of the multi-hole throttling cone can be decreased and the pump power can be reduced accordingly. The steam cooling aperture which is disposed immediately downstream, causes a further throttling of the steam flow and good atomization of the water injected in the region of high steam velocities.

In accordance with again a further feature of the invention, the second throttling device is in the form of a multi-hole steam cooling aperture. In this way, the steam and water distribution is improved further.

In accordance with again an added feature of the invention, the throttling devices also include further throttling devices disposed between the second throttling device and the throttling device disposed farthest downstream. The spacings between these further throttling devices can then be matched to the throttling cross sections, in such a manner that the steam velocity generated in a tnrottling device is slowed down before the next throttling device is reached, according to the cross section available there. In the supersonic region, this is accomplished by pressure shocks and elsewhere by twirling.

In accordance with again an additional feature of the invention, the further throttling devices are in the form of multi-hole throttling cones disposed outside the steam dome wall. This results in an extremely simple structure in which the construction of the throttling devices as multi-hole throttling cones offers advantages with respect to strength, thermal expansion and vibration behavior.

In accordance with yet another feature of the invention, at least part of the further throttling devices are in the form of nested inserts disposed in the steam dome conforming to the contour of said steam dome wall. A bypass steam inlet constructed in such a manner can be made extremely short, in view of the low space requirement outside of the steam dome.

In accordance with yet a further feature of the invention, the further throttling devices are in the form of multi-hole throttling cones or roof-shaped inserts having roof surfaces with perforations formed therein.

In accordance with yet an added feature of the invention, there is provided a short semicylindrical section interconnecting two halves of the roof surfaces.

If additional and uniform cooling of the bypass steam is to be achieved, in accordance with yet an additional feature of the invention, there is provided a further water injection device associated with at least one of the further throttling devices.

In accordance with still a further feature of the invention, there is provided a preheater disposed in the steam dome, the steam dome wall including an end surface, and the bypass steam inlet discharging into the end surface laterally adjacent the preheater.

In accordance with a concomitant feature of the invention, there is provided another steam inlet discharging into the end surface laterally adjacent the preheater and on an opposite side of the preheater than the first-mentioned bypass steam inlet. Due to the small space required for the internal component forming the last or final throttling device which conforms to the contour of the steam dome wall on the inside, sufficient space is therefore available for one or two bypass steam inlets, for a preheater and for placement of the steam removal tubes, without mutual impediment. Other features which are considered to be characteristic for the invention are set forth in the appended claims.

Although the invention is illustrated and described herein as embodied in a turbine condenser with at least one bypass steam inlet leading into the steam dome, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
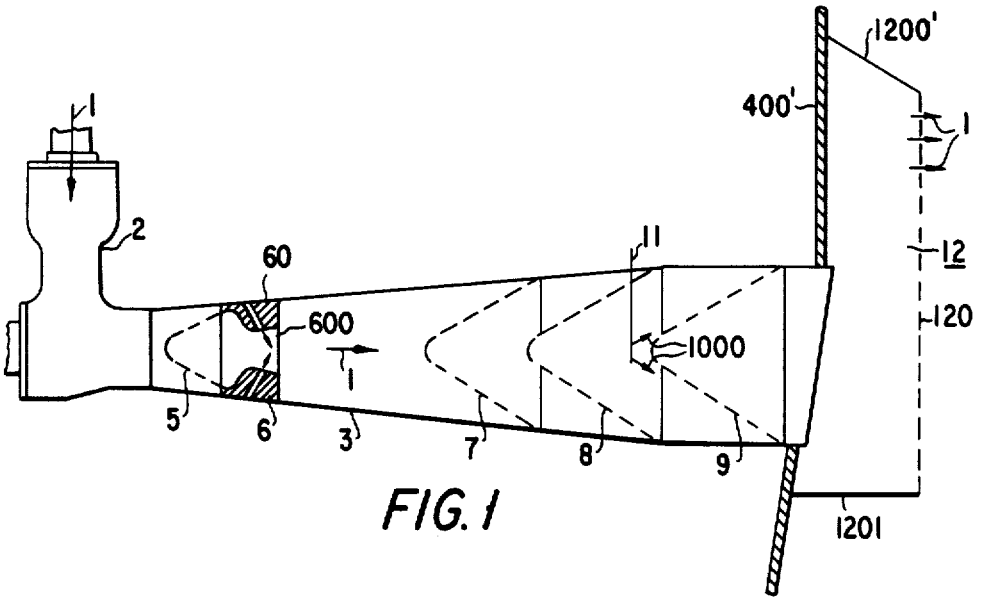
FIG. 1 is a fragmentary, diagrammatic, cross-sectional view of a first embodiment of a bypass steam inlet.

Referring now to the figures of the drawing and first particularly to FIG. 1 thereof, there is seen a greatly simplified diagrammatic view of a first embodiment of a bypass steam inlet. The bypass steam indicated by arrows 1 first arrives at a bypass valve 2, which controls the amount of bypass steam according to the prevailing operating conditions of the turbine. The bypass valve 2 is followed by a pipe stub 3 which expands conically in the flow direction and which is welded at one end thereof to a steam dome wall of a turbine condenser. A first throttling device 5 which is constructed as a multi-hole throttling cone expanding in the flow direction, is first of all disposed downstream of the bypass valve 2, within the pipe stub 3. Besides the throttling of the bypass steam 1, the first throttling device 5 is also utilized to provide a settling of the flow which is highly turbulent at this point. A second throttling device 6 in the form of a steam cooling aperture, is disposed immediately downstream of the first throttling device 5. The second throttling device 6 has several drill holes 60 formed tnerein which are distributed in the circumferential direction and are slightly inclined in the flow direction, through which water or condensate is injected as indicated by the arrows 600, for cooling tne bypass steam 1. The flow cross section of the second throttling device 6 is matched to the variation of the velocity, and the injection of the water 600 takes place at points of maximum steam velocity for atomizing reasons.

The second throttling device 6 is followed sequentially by a third throttling device 7, a fourth throttling device 8 and a fifth throttling device 9, each of which is constructed in the form of a multi-hole throttling cone expanding in the flow direction. The axial spacings of the further throttling devices 7, 8 and 9 are matched in this case to the hole diameters of the throttling cross sections, in such a manner that the velocity of the bypass steam generated at a throttling point is slowed down before the next throttling point is reached in accordance with the cross section available at the throttling point. This is accomplished in the supersonic range by pressure shocks and otherwise by turbulence.

Other water injection devices can be associated with the further throttling devices 7, 8 and 9, for the further and uniform cooling of the bypass steam 1. Thus, a further water injection device 11 is disposed immediately upstream of the throttling device 9 in the embodiment shown, through which water is injected as indicated by arrows 1100. In view of strength, thermal expansion and vibration behavior, it is advantageous to construct the further throttling devices 7, 8 and 9 in the form of multi-hole throttling cones. This provides advantageous conditions for twirling and mixing the bypass steam 1 with the injected water 600 or 1100, since the flow is conducted inward through the holes in a multi-hole throttling cone and is forced outward again upstream of the following multi-hole throttling cone.

If the volumetric flow of the bypass steam 1 increases further, the axial flow velocity approaches the sound barrier. The last throttling device 12 downstream of the throttling device 9 is therefore no longer disposed within the pipe stub 3, but is instead within the steam dome of the turbine condenser. The last throttling device 12 is constructed in the form of a multi-hole semicylinder 120 wnich is aligned vertically, i.e. in the flow direction of the exhaust steam of the turbine, so as to interfere as little as possible with the exhaust steam from the last turbine stage through the steam dome into the turbine condenser, in normal operation of the turbine. The semicylinder 120 is an insert of the steam dome which conforms to the contour of the steam dome wall 400 from the inside. The multi-hole semicylinder 120 has an upper boundary wall 1200 at the upper surface and a lower boundary wall 1201 at the lower surface. The upper boundary wall 1200 is disposed at an angle wnich is advantageous for the flow in view of the exhaust steam flowing into the steam dome. The bypass steam 1 flows from the tube stub 3 into the last throttling device 12 in the form of a T section. This is to avoid constrictions of the flow cross section.

The purpose of providing the last throttling device 12 with a multi-hole semicylinder 120, is to permit the bypass steam 1 to enter into the steam dome through the individual holes in the form of divergent individual jets; it is no longer possible to combine these individual jets to form a single jet. Each of these individual jets should therefore be considered as a free jet so that short jet lengths are obtained. The danger of vibration excitation and droplet impact erosion of exposed components, is thereby eliminated.

Figure 2:
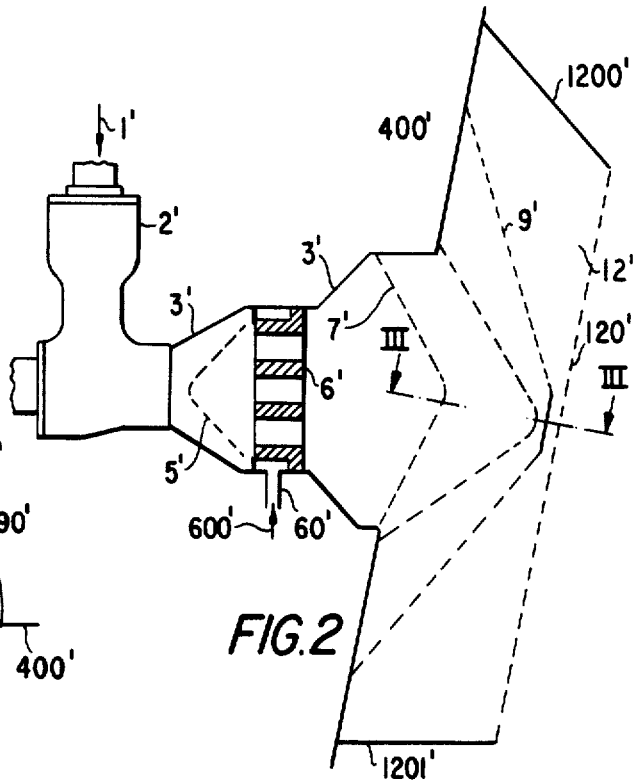
FIG. 2 is a fragmentary, cross-sectional view of a second embodiment of a bypass steam inlet.

The throttling cross sections of the series-connected throttling devices 5, 6, 7, 8, 9 and 12 increase as viewed downstream, so that the bypass steam 1 can be throttled in such a manner that the velocity of sound is exceeded as little as possible. In particular, the last throttling device 12 can be provided in the form of an insert of the steam dome having such a large throttling cross section, that the bypass steam 1 only moderately exceeds the velocity of sound when entering the steam dome; due to a corresponding breakdown of the residual gradient. FIG. 2 shows a very greatly simplified diagrammatic view of a second embodiment of a bypass steam inlet. The bypass steam indicated by arrows 1' in this case flows successively through a bypass valve 2', a first throttling device 5' constructed in the form of a multi-hole throttling cone, a second throttling device 6' which is disposed immediately downstream of the first throttling device and is constructed in the form of a multi-hole steam cooling aperture, a third throttling device 7' constructed in the form of a multi-hole throttling cone, a fourth throttling device 8' likewise constructed in the form of a multi-hole throttling cone, a fifth throttling device 9' constructed in the form of a roof-shaped insert with perforated roof surfaces, and a final throttling device 12' which is constructed in the form of a multi-hole semicylinder 120' with an upper inclined boundary wall 1200' on the end thereof and a boundary wall 1201' at the lower end thereof. The first throttling device 5', the second throttling device 6' and the third throttling device 7' are disposed in this embodiment within a pipe stub 3' which expands conically in steps. On the other hand, the fourth throttling device 8', the fifth throttling device 9' and the final throttling device 12' are in the form of nested inserts of the steam dome, which are fastened to the steam dome wall 400' from the inside. The entire bypass steam inlet therefore has an extremely short structural length outside of the steam dome.

The second throttling device 6' is constructed in the form of a multi-hole steam cooling aperture, in order.to obtain better distribution of the bypass steam 1' and water 600' fed in through a line 60' and an annular canal. The short distances between the individual throttling points are taken into consideration by providing respective small hole diameters. In order to prevent the steam jets generated at one throttling point from blowing directly against the holes of the next throttling point, holes have been omitted where the distances are too short.

Figure 3:
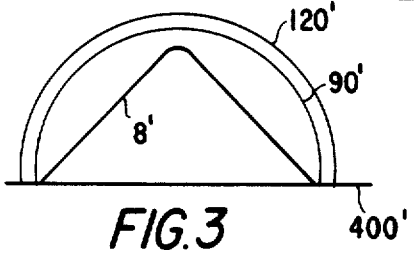
FIG. 3 is a cross-sectional view taken along the line III—III of FIG. 2, in the direction of the arrows.

The fifth throttling device 9' is constructed in the form of an insert with perforated roof surfaces. The roof surfaces are connected to each other by a short semicylinder section 90'. This short semicylinder section 90' can also be seen in the cross-sectional view of FIG. 3. FIG. 3 furhermore illustrates the fastening of the multi-hole semicylinder 120' of the final throttling device 12' and the fastening of the multi-throttling cone of the fourth throttling device 8', to the steam dome wall 400'.

Figure 4:
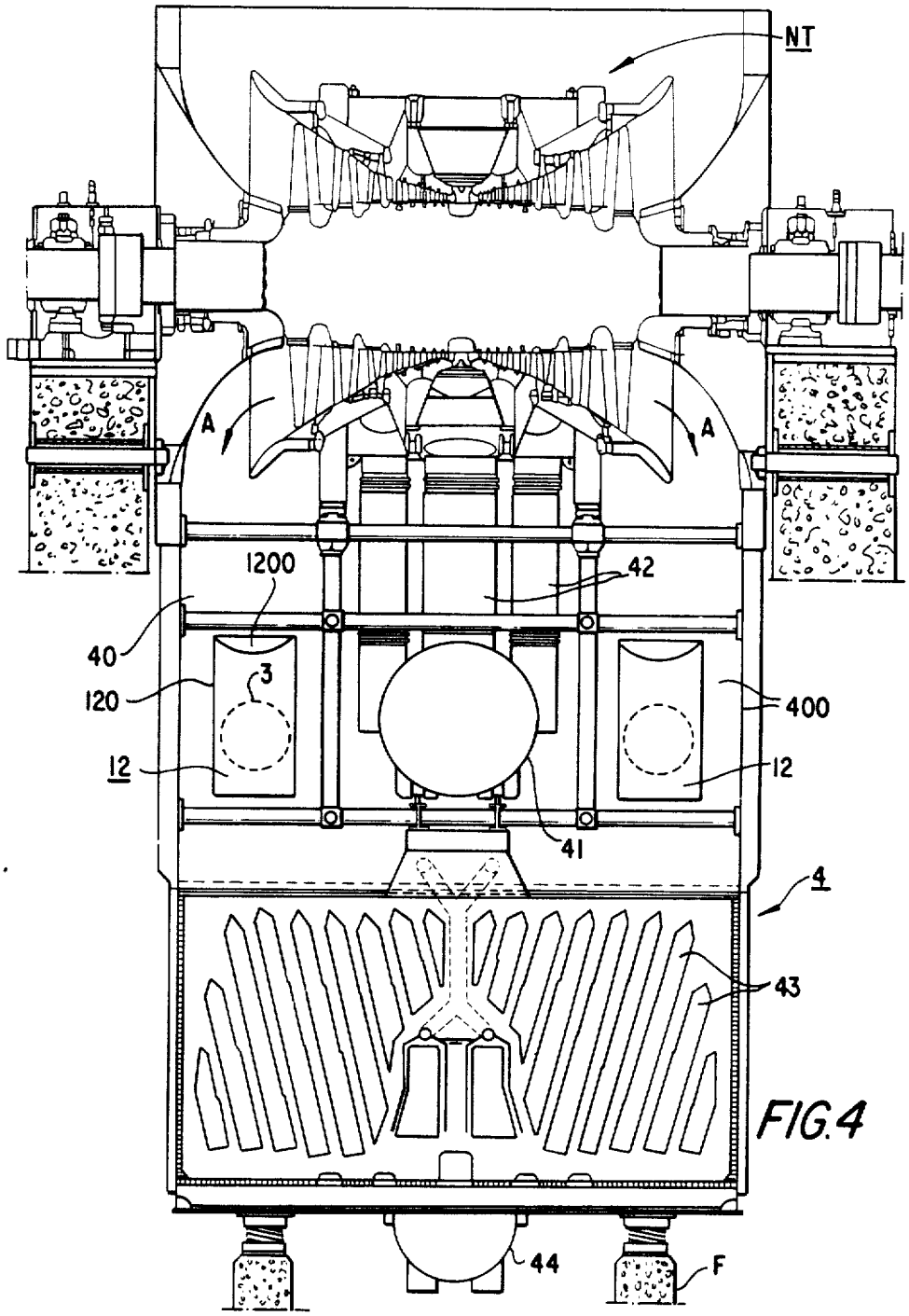
FIG. 4 is a vertical-sectional view of a turbine condenser with two bypass steam inlets constructed in accordance with FIG. 1.

FIG. 4 is a vertical section through a turbine condenser, designated as a whole with reference numeral 4. The condenser is resiliently supported on a foundation F below a low-pressure turbine section NT. In FIG. 4, the steam dome is designated with reference numeral 40, the steam dome wall with reference numeral 400, a preheater built into the steam dome 40 with reference numeral 41, steam removal or bleed pipes disposed in vicinity of the steam dome 40 with reference numeral 42, tube bundles disposed in the lower region with reference numeral 43 and a condensate collecting container with reference numeral 44. One of the bypass steam inlets shown in FIG. 2 discharges into the steam dome 40 adjacent each respective side of the preheater 41. The last throttling device 12 of each bypass steam inlet with the multi-hole semicylinder 120 and the upper terminating wall 1200 as well as the pipe stub 3 welded into the steam dome wall 400 at the end of each of the bypass steam inlets can be seen. It can furthermore be seen that the last throttling devices 12 which conform to the steam dome wall 400 as inserts from the inside, cannot appreciably interfere with exhaust steam A leaving the outlet housing with a diffusor during normal operation. Uniform exposure of tne tube bundles 43 is therefore assured. In addition, the noise level produced is greatly mitigated by the above-described special construction of the bypass steam inlets and particularly of the final throttling device. The danger of exciting vibrations and of droplet-impact erosion of the blades of the low-pressure turbine section NT and the individual components of the turbine condenser 4, is therefore eliminated.

The foregoing is a description corresponding in substance to German Application No. P 32 40 453.0, dated Nov. 2, 1982, the International priority of which is being claimed for the instant application, and which is hereby made part of this application. Any material discrepancies between the foregoing specification and the aforementioned corresponding German application are to be resolved in favor of the latter.

We claim:

1. In a turbine condenser, the improvement comprising a steam dome of the condenser having a wall, at least one bypass steam inlet discharging into said steam dome, said bypass steam inlet including a bypass valve for controlling the amount of bypass steam in said bypass steam inlet, at least two series-connected throttling devices disposed downstream of said bypass valve for decompressing the bypass steam, each respective throttling device disposed relatively further downstream having a larger cross setion than each throttling device disposed relatively further upstream, said throttling device disposed farthest downstream being in the form of an insert with a convex curvature and a multiplicity of holes formed therein disposed in said steam dome conforming to the contour of said steam doem wall, and a device for injecting water into said bypass steam inlet cooling the bypass steam, said insert being in the form of a substantially verical multi-hole semicylinder being cut parallel to the axis of the bypass steam inlet and having outer walls including an upper wall upwardly inclined toward said steam dome wall.

2. In a turbine condenser, the improvement comprising a steam dome of the condenser having a wall, at least one bypass steam inlet discharging into said steam dome, said bypass steam inlet including a bypass valve for controlling the amount of bypass steam in said bypass steam inlet, at least two series-connected throttling device disposed downstream of said bypass valve for decompressing the bypass steam, each respective throttling device disposed relatively further downstream having a larger cross section than each throttling device disposed relatively further upstream, said throttling device disposed farthest downstream being in the form of an insert with a convex curvature and a multiplicity of holes formed therein disposed in said steam dome conforming to the contour of said dome wall, and a device for injecting water into said bypass steam inlet cooling the bypass steam, said throttling devices including a first throttling device in the form of a multi-hole throttling cone, and a second throttling device in the form of a steam cooling aperture.

3. Turbine condenser according to claim 2, wherein said second tnrottling device is in the form of a multi-hole steam cooling aperture.

4. Turbine condenser according to claim 2, wherein said throttling devices also include further throttling devices disposed between said second throttling device and said throttling device disposed farthest downstream.

5. Turbine condenser according to claim 4, wherein said further throttling devices are in the form of multi-hole throttling cones disposed outside said steam dome wall.

6. Turbine condenser according to claim 4, wherein at least part of said further throttling devices are in the form of nested inserts disposed in said steam dome conforming to the contour of said steam dome wall.

7. Turbine condenser according to claim 6, wherein said further throttling devices are in the form of multi-hole throttling cones.

8. Turbine condenser according to claim 6, wherein said further tnrottling devices are in the form of roof-shaped inserts having roof surfaces with perforations formed therein.

9. Turbine condenser according to claim 8, including a semicylindrical section interconnecting two of said roof surfaces.

10. Turbine condenser according to claim 4, including a further water injection device associated with at least one of said further throttling devices.

11. In a turbine condenser, the improvement comprising a steam dome of the condenser having a wall, at least one bypass steam inlet discharging into said steam dome, said bypass steam inlet including a bypass valve for controlling the amount of bypass steam in said bypass steam inlet, at least two series-connected throttling devices disposed downstream of said bypass valve for decompressing the bypass steam, each respective throttling device disposed relatively further downstream having a larger cross section than each throttling device disposed relatively further upstream, said throttling device disposed farthest downstream being in the form of an insert with a convex curvature and a multiplicity of holes formed therein disposed in said steam dome conforming to the contour of said steam dome wall, a device for injecting water into said bypass steam inlet cooling the bypass steam, and a preheater disposed in said steam dome, said steam dome wall including an end surface, and said bypass steam inlet discharging into said end surface laterally adjacent said preheater.

12. Turbine condenser according to claim 11, including another bypass steam inlet discharging into said end surface laterally adjacent said preheater and on an opposite side of said preheater than said first-mentioned bypass steam inlet.

* * * * *